350-96.24 SR
XR 3,983,688

United State
Kockinos

[11] 3,983,688
[45] Oct. 5, 1976

ADDED

[54] WORLD CLOCK DEVICE

[75] Inventor: Constantin N. Kockinos, Mountain View, Calif.

[73] Assignee: The Raymond Lee Organization, Inc., New York, N.Y. ; a part interest

[22] Filed: June 19, 1975

[21] Appl. No.: 588,374

[52] U.S. Cl. ..... 58/44; 58/50 R; 58/42.5
[51] Int. Cl.[2] ..... G04B 1/26
[58] Field of Search ..... 58/42.5, 44, 50, 2; 350/96 B, 96 BC; 353/40

[56] References Cited

UNITED STATES PATENTS

| | | | |
|---|---|---|---|
| 2,068,418 | 1/1937 | Kyack | 58/44 X |
| 2,223,605 | 12/1940 | Dupler | 58/44 |
| 2,253,747 | 8/1941 | Alland | 58/44 |
| 2,300,621 | 11/1942 | Dupler | 58/44 |
| 3,184,911 | 5/1965 | Canale et al. | 58/44 |
| 3,370,415 | 2/1968 | McIlvaine | 58/44 |
| 3,397,630 | 8/1968 | Pratt, Jr. | 250/319 X |
| 3,478,665 | 11/1969 | Umahashi et al. | 219/216 |
| 3,527,046 | 9/1970 | Pawl | 58/44 |
| 3,628,440 | 12/1971 | Czarnikow et al. | 219/216 X |
| 3,666,247 | 5/1972 | Banks | 432/60 |
| 3,893,800 | 7/1975 | Wako | 432/60 |

FOREIGN PATENTS OR APPLICATIONS

| | | | |
|---|---|---|---|
| 873,158 | 4/1953 | Germany | 58/44 |
| 22,256 | 10/1968 | United Kingdom | 58/44 |

*Primary Examiner*—Ulysses Weldon
*Attorney, Agent, or Firm*—Daniel Jay Tick

[57] ABSTRACT

A plurality of clocks are provided in a housing having a plurality of faces, each clock being in a corresponding one of the faces of the housing. A transparent globe of the Earth is rotatably mounted in the housing. A rotating device in the housing is coupled to the globe for rotating the globe. A time projecting device in the globe projects numbers indicating the time along the Equator of the globe. A color arrangement colors daylight time one color and night time another color.

3 Claims, 3 Drawing Figures

3983688
OR IN 58/44

WORLD CLOCK DEVICE

DESCRIPTION OF THE INVENTION

The present invention relates to a world clock device.

Objects of the invention are to provide a world clock device of simple structure, which is inexpensive in manufacture and functions efficiently, effectively and reliably to indicate the time at different points all over the world and simultaneously indicate daylight and night.

In order that the invention may be readily carried into effect, it will now be described with reference to the accompanying drawing, wherein.

Figure 1:
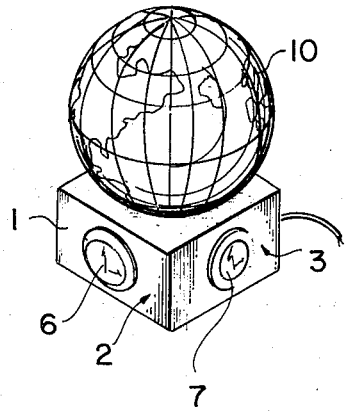
FIG. 1 is a schematic diagram of an embodiment of the world clock device of the invention.

The world clock device of the invention comprises a housing 1 having a plurality of faces 2, 3 (FIG. 1), 4 and 5 (not shown in the FIGS.). Each of a plurality of clocks 6, 7 (FIG. 1), 8 and 9 (not shown in the FIGS.) is provided in a corresponding one of the faces 2 to 5 of the housing.

A transparent globe 10 of the Earth is rotatably mounted on the housing.

A rotating device of any suitable known type is provided in the housing 1 coupled to the globe 10 for rotating said globe. The rotating device may thus comprise an electric motor 11 coupled to the globe 10 via a gear arrangement 12.

Figure 2:
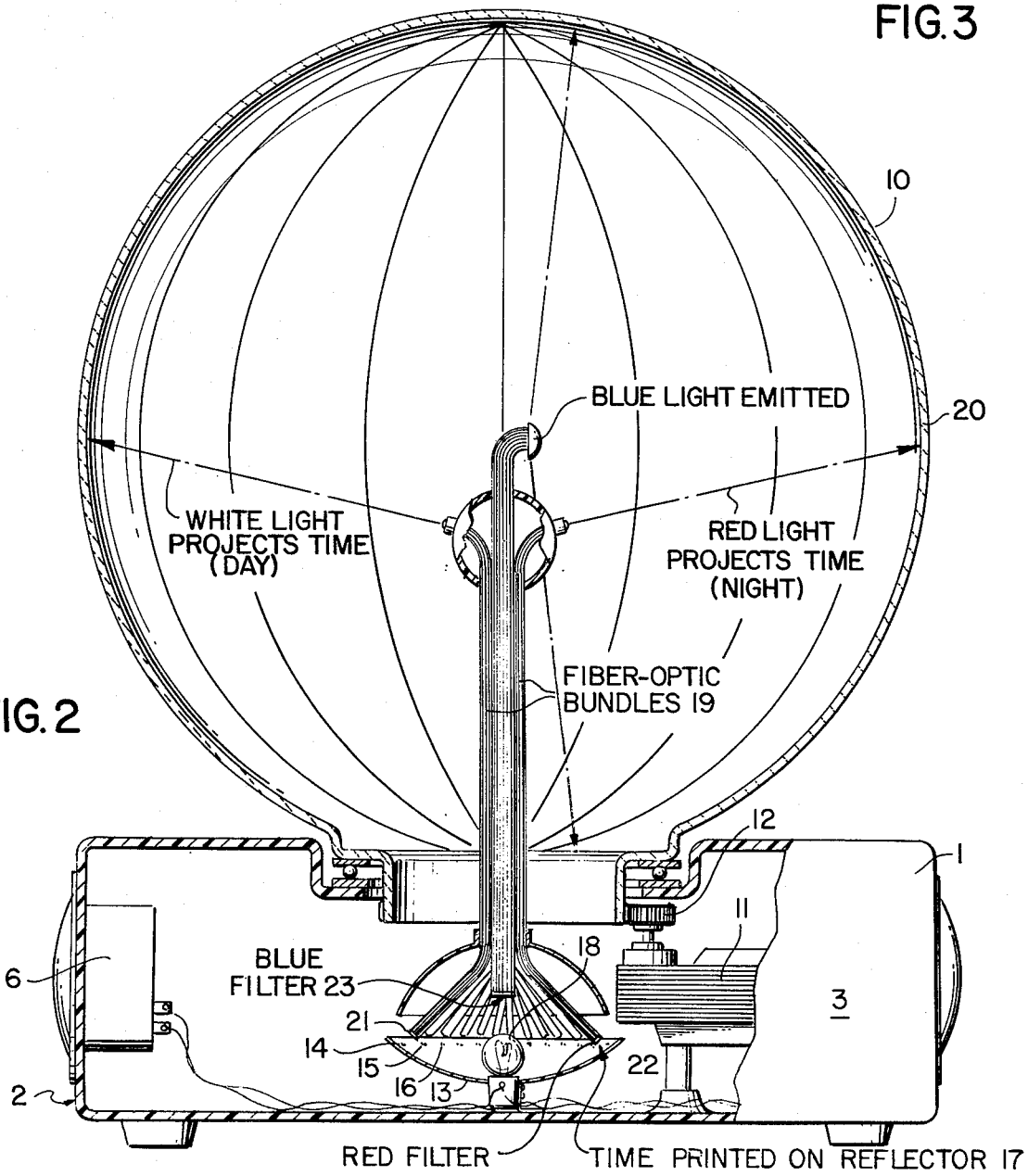
FIG. 2 is a cross section view, partly in section, and partly cut away, on an enlarged scale, of an embodiment of the world clock device of the invention.

A time projecting device is provided in the globe 10 for projecting numbers indicating the time along the Equator of the globe. In the embodiment of FIG. 2, the time projecting device comprises a light reflector 13 in the housing 1 having time numerals 14, 15, 16, 17, and so on, on the reflector adjacent the rim thereof. A source of light 18 is positioned at the focal point of the reflector 13. A light conducting device such as, for example, fiber-optic bundles 19, transfers the time number light reflected from the reflector to the Equator 20 of the globe 10.

A color arrangement colors daylight time white and night time red. The color device of the embodiment of FIG. 2 comprises a plurality of red filters 21, 22, and so on, interposed between predetermined numbers on the reflector and the light conducting device 19. A blue filter 23 at the base of the fiber-optic bundles 19 provides blue light, indicating night time, over half the globe 10.

Figure 3:
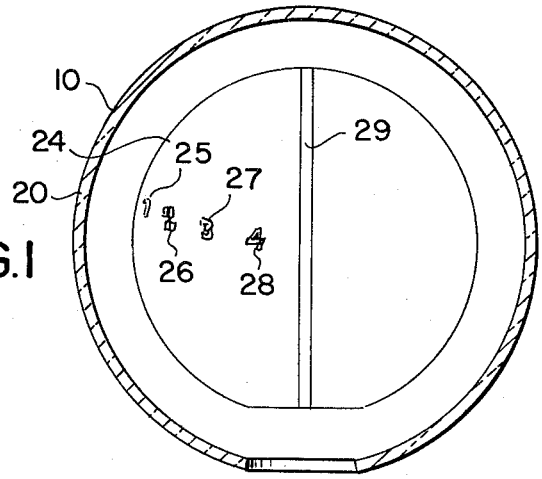
FIG. 3 is a view, partly in section, of part of another embodiment of the world clock device of the invention.

The time projecting device of the embodiment of FIG. 3 comprises a transparent globe 24 coaxially positioned inside the globe 10 of the Earth and having time numerals 25, 26, 27, 28, and so on, cut out thereof in the Equatorial area thereof. Half the inside globe 24 is blue and half the inside globe is white, with a dividing strip 29, representing sunrise, being red. The same source of light 18 and light conducting device of the same type as the fiber-optic bundles 19 are utilized. The light conducting device transfers beams of white light through the numbers 25, 26, 27, 28, and so on, and the red strip 29, to the Equator 20 of the globe 10 of the Earth.

While the invention has been described by means of specific examples and in specific embodiments, I do not wish to be limited thereto, for obvious modifications will occur to those skilled in the art without departing from the spirit and scope of the invention.

I claim:

1. A world clock device, comprising a housing having a plurality of faces and a light source;

a plurality of clocks each in a corresponding one of the faces of the housing;

a transparent globe of the Earth rotatably mounted on the housing;

rotating means in the housing coupled to the globe for rotating said globe;

time projecting means in the housing and the globe for projecting numbers indicating the time along the Equator of the globe, said time projecting means comprising light conducting means extending between the housing and the globe for transmitting light from said light source for indicating the time and projecting said numbers on the Equator of the globe; and color means for coloring daylight time one color and night time another color.

2. A world clock device as claimed in claim 1, wherein the time projecting means comprises a transparent globe coaxially positioned inside the globe on the Earth and having time numerals cut out thereof, the color means comprises half the inside globe being blue and half being white with a dividing strip representing sunrise being red, and the time projecting means comprises said source of light in the housing and said light conducting means for transferring beams of light through the numbers and the red strip to the Equator of the globe of the Earth.

3. A world clock device as claimed in claim 1, wherein the color means comprises filter means interposed between recorded predetermined numbers in the housing and the light conducting means.

* * * * *